US008093815B2

(12) United States Patent
Hendricx et al.

(10) Patent No.: US 8,093,815 B2
(45) Date of Patent: Jan. 10, 2012

(54) HIGH-PRESSURE DISCHARGE LAMP HAVING A CERAMIC DISCHARGE VESSEL DIRECTLY SEALED TO A ROD

(75) Inventors: Josephus Christiaan Maria Hendricx, Eindhoven (NL); Peter Jozef Vrugt, Eindhoven (NL); Franciscus Johannes Gerardus Hakkens, Eindhoven (NL); Cornelis Johannes Maria Denissen, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 169 days.

(21) Appl. No.: 12/518,646

(22) PCT Filed: Dec. 14, 2007

(86) PCT No.: PCT/IB2007/055103

§ 371 (c)(1),
(2), (4) Date: Jun. 11, 2009

(87) PCT Pub. No.: WO2008/075273

PCT Pub. Date: Jun. 26, 2008

(65) Prior Publication Data

US 2009/0267515 A1 Oct. 29, 2009

(30) Foreign Application Priority Data

Dec. 18, 2006 (EP) ..... 06126301

(51) Int. Cl.
*H01J 61/30* (2006.01)
*H01J 61/36* (2006.01)

(52) U.S. Cl. ..... 313/636; 313/625; 313/626; 313/627; 313/623; 313/624

(58) Field of Classification Search ..... 313/623–642, 313/627
See application file for complete search history.

(56) References Cited

U.S. PATENT DOCUMENTS

| | | | | |
|---|---|---|---|---|
| 5,424,609 | A * | 6/1995 | Geven et al. | 313/623 |
| 5,637,960 | A * | 6/1997 | Juengst et al. | 313/625 |
| 6,066,918 | A * | 5/2000 | Suzuki et al. | 313/623 |
| 6,861,805 | B2 * | 3/2005 | Jackson et al. | 313/607 |
| 2001/0003411 | A1 * | 6/2001 | Honda et al. | 313/607 |
| 2004/0119413 | A1 | 6/2004 | Kebbede et al. | |

FOREIGN PATENT DOCUMENTS

| | | | |
|---|---|---|---|
| DE | 19933154 | A1 | 2/2001 |
| EP | 0175502 | B1 | 3/1986 |
| EP | 0204303 | A2 | 12/1986 |
| EP | 204303 | A2 * | 12/1986 |
| EP | 0528427 | B1 | 2/1993 |
| EP | 0587238 | A1 | 3/1994 |
| EP | 0609477 | A1 | 8/1994 |
| EP | 1580797 | A2 | 9/2005 |
| EP | 1708247 | A1 | 10/2006 |
| WO | WO 2005001883 | A2 * | 1/2005 |
| WO | 2005078766 | A2 | 8/2005 |
| WO | 2005124823 | A1 | 12/2005 |

* cited by examiner

*Primary Examiner* — Anne Hines
*Assistant Examiner* — Tracie Green

(57) ABSTRACT

A high-pressure discharge lamp and a reflector lamp including a discharge vessel enclosing a discharge space which is provided with an ionizable filling comprising one or more halides. The discharge vessel is substantially constituted by a ceramic material having first and second end portions. Current-supply conductors issue through each end portion to respective electrodes arranged in the discharge space so as to maintain a discharge. At least one of the current-supply conductors is formed as a rod including iridium. The rod is directly sealed to the ceramic material.

4 Claims, 3 Drawing Sheets

HIGH-PRESSURE DISCHARGE LAMP HAVING A CERAMIC DISCHARGE VESSEL DIRECTLY SEALED TO A ROD

FIELD OF THE INVENTION

The invention relates to a high-pressure discharge lamp having a ceramic discharge vessel.

The invention also relates to a reflector lamp.

BACKGROUND OF THE INVENTION

High-pressure discharge lamps having a ceramic discharge vessel contain fillings which, besides a noble gas, such as, for example, argon or Xe gas, also comprise metal halide salt mixtures such as NaCe, NaTl, NaSc, and NaTlDy halide, for example, iodide or combinations of these salts. These metal halide salt mixtures are applied to obtain, inter alia, a high lamp efficacy, a specific color temperature and a specific value of the general color rendering index Ra.

High-pressure discharge lamps of this type generally have a discharge vessel which encloses a discharge space comprising the filling of the metal halide salt mixtures. The discharge space further comprises electrodes between which a discharge is maintained. Typically, the electrodes are connected to lead-through conductors, also referred to as feed-through conductors, which pierce the discharge vessel. To connect the lead-through conductors to the discharge vessel and seal it, a glass material, also known as frit, is generally used. However, due to the relatively low melting temperature of the frit and the relatively high temperatures at the discharge space of the discharge vessel when the high-pressure discharge lamp is in operation, the discharge vessel comprises extended plugs in which the frit seals the electrode lead-through conductors to the discharge vessel.

An alternative embodiment of the high-pressure discharge lamp is known from PCT patent application WO 2005/124823. The known high-pressure discharge lamp has a discharge vessel comprising a first and a second closing construction at respective sides of the discharge vessel. The closing constructions are connected to the discharge vessel and comprise a respective first and second current feed-through, at least the second of which comprises a tube having a sintered bond to the extended ceramic plug forming the second closing construction. The tube, which consists of a metal chosen from molybdenum, rhenium, tungsten, iridium, their alloys, and optionally also comprises vanadium and/or titanium, encloses a current-supply conductor while maintaining a capillary space. The tube and the current-supply conductor are welded together at an external end of the extended ceramic plug, which weld constitutes a hermetic seal of the capillary space. The known high-pressure discharge lamp has the drawback of a rather complex closing construction and a relatively short lifetime.

A further known lamp construction is described in EP1580797. This lamp has a lead-through construction of at least one ball-shaped piece made of metal chosen from the platinum group and being sealed to a ceramic plug by means of a solder.

This known construction has a number of drawbacks. During the sealing process, the solder tends to run down outside the sealing area and over the electrode itself. The solder mass thus present inside the discharge space enclosed by the discharge vessel contaminates the filling of the discharge space, which adversely affects the light properties of the lamp and thus has a detrimental effect on its lifetime.

Furthermore, the ball shape is disadvantageous because it presents problems when the volume bounded by the ceramic plug and the lead-through element is completely filled. This is all the more true when the lead-through element is composed of a row of two or more ball-shaped pieces.

Moreover, it is a drawback that there is no suitable solder that can form a strong bond with the ceramic plug and the metal of the lead-through element and also withstands the lamp operating conditions for a lamp life span of more than 1000 hours.

OBJECT AND SUMMARY OF THE INVENTION

It is an object of the invention to provide a metal halide discharge lamp having a longer lifetime.

According to a first aspect of the invention, the object is achieved with a high-pressure discharge lamp having a discharge vessel enclosing a discharge space which is provided with an ionizable filling comprising one or more halides, the discharge vessel being substantially constituted by a ceramic material having first and second end portions, and current-supply conductors issuing through each end portion to respective electrodes arranged in the discharge space so as to maintain a discharge, at least one of the current-supply conductors being formed as a rod comprising iridium. In a preferred embodiment, the rod is directly sealed to the ceramic material.

The effect of the measures according to the invention is that use of the rod comprising iridium directly sealed to the ceramic material results in a greatly reduced risk of cracks being formed in the ceramic material of the discharge vessel wall at the interface of the rod and the ceramic material. This has a significant effect on an effective increase of the lifetime of the high-pressure discharge lamp.

In a preferred embodiment of the high-pressure discharge lamp according to the invention, the rod is directly sealed to the ceramic material by means of a sintered bond, which results in a vacuum-tight closure or seal of the discharge vessel via a direct connection between the rod and the ceramic material. A cross-section of the rod may have any shape, for example, a circular, elliptical, square, or angular shape.

In a further preferred embodiment, the lead-through rod comprising Ir is directly fastened to the wall of the ceramic discharge vessel by means of a suitable sealing composition, such as, for example, sealing glass or crystalline sealing ceramic, thus forming a hermetic seal of the discharge vessel.

The inventors have realized that the tube, which is directly sintered to the ceramic material in the known high-pressure discharge lamp, will be repeatedly deformed due to heating and cooling of the known high-pressure discharge lamp when switched on and off. This repeated deformation in the known high-pressure discharge lamp will result in cracks in the ceramic material, especially at the interface between the tube and the ceramic material, which will result in leakage of the discharge vessel, typically resulting in the end of life of the known high-pressure discharge lamp. When a rod comprising iridium according to the invention is used, the rod will be less deformed in comparison with a tube and, as such, the cracks at the interface between the rod and the ceramic material will be reduced, resulting in a longer lifetime of the high-pressure gas discharge lamp.

It is true that the difference in thermal rate of expansion of Ir and Nb is negligible in relation to the thermal rate of expansion of alumina. However, Nb, which is by far the most common metal used for lead-through conductors in ceramic discharge vessels, is certainly more ductile than Ir. In this respect, it is surprising that, in forming the directly sealed lead-through element, an Ir rod results in a reliable and long-lasting feed-through construction of a high-pressure discharge lamp. Besides, it results in a much less complex construction of the feed-through sealing of the lamp, which is a great advantage in mass production on an industrial scale.

Use of an iridium rod which is directly sealed to the ceramic material according to the invention has the further advantage of a smaller discharge vessel, which results in a further miniaturization of the high-pressure discharge lamp. When the rod comprising iridium is directly sealed to the ceramic material by means of a sintered bond, a connection between the rod comprising iridium and the ceramic material can generally withstand high temperatures, so that the connection between the rod and the ceramic material may be applied relatively close to the discharge of the discharge vessel. This allows miniaturization of the high-pressure discharge lamp.

When the direct seal is made by means of a sealing frit, the sealing frit generally comprises a composition of different glass-like materials, such as $Al_2O_3$, $Dy_2O_3$ and $SiO_2$. An aspect of using the sealing frit is that typically its melting point is lower than the average operating temperature in the discharge space of the high-pressure discharge lamp. As a result, the sealing frit is preferably applied at some distance from the discharge space of the high-pressure gas discharge lamp. Particularly in a discharge vessel of small dimensions, this is achieved by the first and second end portions of the high-pressure discharge lamp being formed as a plug, which extends away from the discharge. Due to the relatively low temperatures near the sealing frit in this construction, salt components of the ionizable filling of the high-pressure discharge lamp comprising one or more halides will have a considerably reduced reactivity with the frit.

Use of an iridium rod which is directly sealed to the ceramic material according to the invention has the additional advantage that it allows a relatively high temperature throughout the discharge vessel, in particular when the direct seal is formed by a sinter bond, which results in a more homogeneous temperature distribution inside the discharge vessel, promotes the maintenance of the lamp and thus contributes to a longer lifetime. Among other features, a relatively high temperature throughout the discharge vessel reduces migration of the ceramic material from one part of the discharge vessel to another part, which further contributes to a longer lifetime of the high-pressure discharge lamp. In discharge lamps with extending plugs projecting considerably far away from the discharge, a relatively large temperature difference will occur between the discharge vessel near the discharge and near the end portions of the extended plug. This relatively large temperature difference may cause ceramic material to migrate from the inner wall of the discharge vessel to the end portions, which would weaken the discharge vessel near the discharge and thus shorten the lifetime of the high-pressure discharge lamp. Use of the rod comprising iridium directly sealed to the ceramic material provides the possibility of keeping the length of an extended plug very much reduced, so that migration of the ceramic material can be decreased, which also contributes to a further increase of the lifetime of the high-pressure discharge lamp. A further advantage of a relatively homogeneous temperature of the high-pressure discharge lamp is improvement of its color stability.

In this description and claims, "ceramic material" is understood to mean a refractory material such as a monocrystalline metal oxide (e.g. sapphire), polycrystalline metal oxide (e.g. polycrystalline densely sintered aluminum oxide and yttrium oxide), and polycrystalline non-oxide material (e.g. aluminum nitride). Such materials can be made translucent when nearly fully dense, allow wall temperatures of 1500 to 1700 Kelvin and are highly resistant to chemical attacks by halides and other filling components. For the purpose of the present invention, polycrystalline aluminum oxide (PCA) has been found to be most suitable.

In an embodiment of the high-pressure discharge lamp, a sintered bond is formed between the rod and the ceramic material, constituting the direct seal between the rod and the ceramic material. This embodiment has the advantage that no crevices are left between the ceramic material and the rod, which minimizes the salt components of the ionizable filling to be extracted from the discharge space by precipitation of the salt components in the crevices. This non-existence of crevices improves the color stability of the high-pressure gas discharge lamp.

In a further embodiment of the discharge lamp according to the invention, the direct seal between the current-supply conductor formed as a rod comprising Ir and the ceramic material of the discharge vessel is formed by means of a sealing frit. This embodiment has the advantage that well-proven lamp fabrication technology can basically be kept unaltered. Besides, the rod shape causes the sealing frit to be spread evenly on the surfaces of both the ceramic part and the Ir rod at the sealing section, resulting in a more reliable and stronger bond than with a current conductor construction having ball-shaped sections.

To further contribute to the quality, strength and durability of the direct seal by means of a sealing frit, the Ir rod and the ceramic material are tapered at the location of the seal. The tapered form of both the ceramic part and the Ir rod as current-supply conductor provides a self-aligning fit between both pieces and thus contributes to an even distribution of the sealing frit across the length of the seal. Besides, the shape of said construction helps to prevent the sealing frit from flowing into the discharge space during the sealing process.

In an alternative construction, the Ir rod is provided with a flange, which is sealed on the outside surface of the ceramic discharge vessel with the sealing frit. In this construction, the flange forms a kind of cap on the head of the ceramic plug or the end of the ceramic vessel wall. By nature of its shape, it is virtually impossible for the sealing frit to flow into the discharge space, while at the same time the seal formed by the sealing frit is located at a relative large distance from the discharge when the lamp is in operation. In this way, both advantages of keeping the sealing frit out of the discharge space and keeping it relatively cool during lamp operation are achieved.

In an embodiment of the high-pressure discharge lamp, the discharge vessel comprises a translucent ceramic burner having the first and the second end portions, and a ceramic plug for sealing the first and/or the second end portions of the translucent ceramic burner, the rod comprising iridium which is directly sealed to the ceramic plug. This embodiment has the advantage that use of a ceramic plug allows a relatively large opening in the translucent ceramic burner, which provides the possibility of using structures at the side of the current-supply conductors facing the discharge. These extending structures are also commonly known as coils or spheres. Use of coils or spheres in the high-pressure discharge lamp has the advantage that they reduce a blackening effect of the discharge vessel due to sputtering of tungsten, which occurs, for example, during ignition of the high-pressure discharge lamp and, for example, when increasing/dimming the light intensity.

In an embodiment of the high-pressure discharge lamp, the ceramic plug and the translucent ceramic burner are constituted by different ceramic materials. This embodiment has the advantage that the ceramic plug can be constituted by the different ceramic material chosen to allow a perfect connection between the rod comprising iridium and the ceramic plug. For example, the different ceramic material is chosen to have a substantially identical coefficient of expansion as compared to the rod comprising iridium, such that thermal stress between the rod and the ceramic plug is minimized. Alternatively, for example, the different ceramic material of the ceramic plug is chosen to form a strong and vacuum-tight seal between the rod and the ceramic plug. The different ceramic material may be composed of, for example, (chemically) different materials as compared to those of the translucent ceramic burner, or it may, for example, only differ from the translucent ceramic burner by a different presintering process, for example, performed at a higher temperature than that for the translucent ceramic burner. Generally, the light generated in the discharge space must be emitted from the high-pressure discharge lamp, and thus at least part of the discharge vessel must be constituted by a translucent ceramic material. When the discharge vessel comprises a translucent ceramic burner and a ceramic plug, the different ceramic material of the ceramic plug does not necessarily have to be translucent, which allows a broader range of ceramic materials to be used as ceramic plug in the high-pressure discharge lamp according to the invention. The ceramic material of the ceramic plug may also change during, for example, a process of sintering the iridium rod into the ceramic plug, with the result that the ceramic material of the ceramic plug is different from the ceramic material of the translucent ceramic burner. This allows use of a sintering process which results in a strong gas-tight connection between the rod and the ceramic plug while, for example, reducing the translucent characteristic of the ceramic material of the ceramic plug.

In an embodiment of the high-pressure discharge lamp, a further sintered bond between the wall of the translucent ceramic burner and the ceramic plug is arranged to seal the translucent ceramic burner with the ceramic plug. This embodiment has the advantage that the further sintered bond is generally resistant to the aggressive environment of the high-pressure discharge lamp and is constituted by only a few different materials, which results in a relatively simple sealing process.

In an embodiment of the high-pressure discharge lamp, a frit is arranged between the translucent ceramic burner wall and the ceramic plug so as to seal the translucent ceramic burner with the ceramic plug. This embodiment has the advantage that the translucent ceramic burner can be sealed with the ceramic plug while using the frit at a relatively low temperature, thus preventing vaporization of the filling components. This is especially beneficial when using mercury as a filling component in the ionizable filling of the discharge vessel, in which case the mercury temperature should not exceed 300° C. before the translucent ceramic burner is sealed.

However, use of the frit for sealing the translucent ceramic burner with the ceramic plug causes the frit to be relatively close to the high-temperature discharge in the discharge space. This construction is therefore particularly suitable in a lamp having very low fill quantities. In a lamp in which the filling is substantially completely vaporized during operation, use of the frit in this way relatively close to discharge space is thus possible.

In an embodiment of the high-pressure discharge lamp, the rod comprising iridium has a diameter of less than 600 μm, and preferably less than 300 μm. Rods having diameters of more than 600 μm often exhibit cracks at the interface between the rod and the ceramic material, generally resulting from a difference between the thermal expansion of the iridium rod and the ceramic material of the discharge vessel. These cracks typically result in leakage of the discharge vessel, typically resulting in the end of life of the high-pressure discharge lamp. On the one hand, smaller diameters ensure less thermal stress at the interface between the rod and the ceramic material and increase the lifetime of the discharge lamp. On the other hand, smaller diameters lead to a reduced conduction, in particular heat conduction. Moreover, it is more complicated to handle such small-diameter rods. A rod diameter of between about 100 μm and 300 μm has turned out to be a good compromise.

The invention further relates to a reflector lamp comprising the high-pressure discharge lamp according to the invention.

BRIEF DESCRIPTION OF THE DRAWINGS

These and other aspects of the invention are apparent from and will be elucidated with reference to the embodiments described hereinafter.

In the drawings.

The Figures are purely diagrammatic and not drawn to scale. Particularly for clarity, some dimensions are exaggerated strongly. Similar components in the Figures are denoted by the same reference numerals as much as possible.

DESCRIPTION OF EMBODIMENTS

Figure 1A:
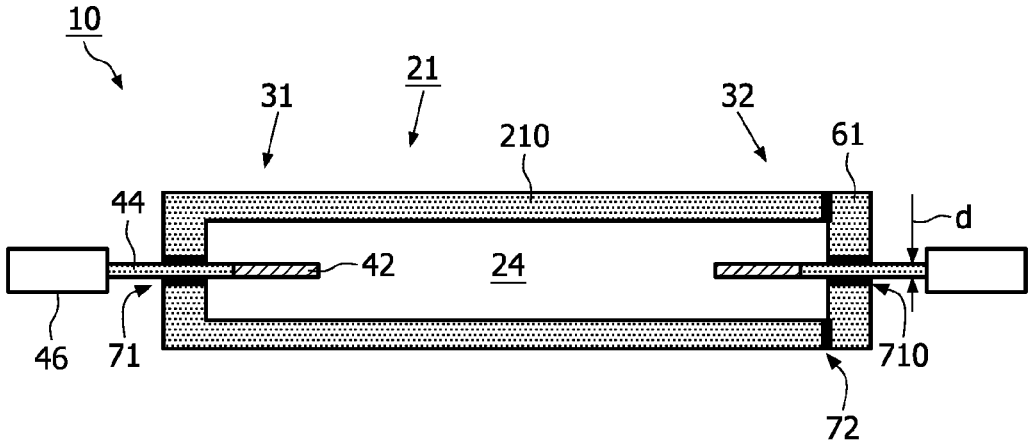
FIGS. 1A and 1B are cross-sectional views of embodiments of a high-pressure discharge lamp according to the invention.
Figure 1B:
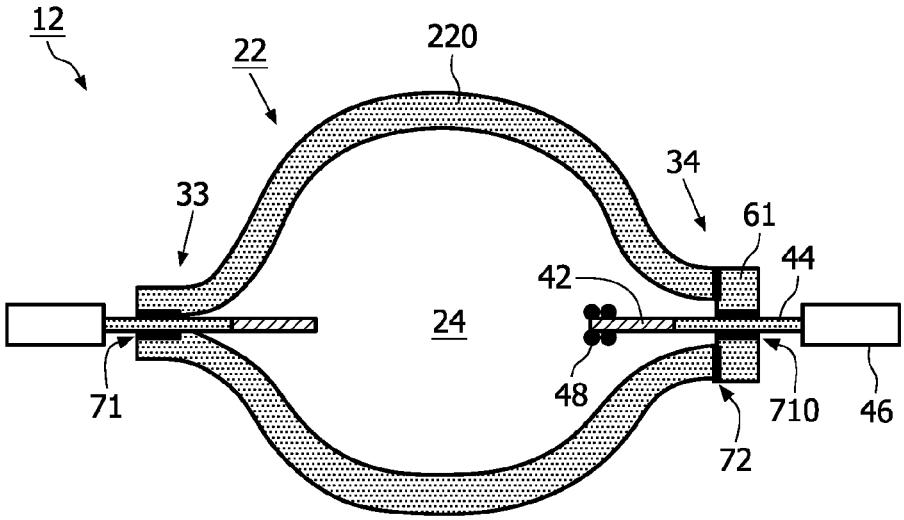

FIGS. 1A and 1B are cross-sectional views of embodiments of high-pressure discharge lamps 10, 12 according to the invention. In these embodiments, the discharge lamp 10, 12 comprises a discharge vessel 21, 22 enclosing a discharge space 24. The discharge vessel 21, 22 is substantially constituted by a ceramic material such as aluminum oxide ($Al_2O_3$). The discharge vessel 21, 22 further comprises a first end portion 31, 33 and a second end portion 32, 34 from which the current-supply conductors 44 issue through the discharge vessel 21, 22. The current-supply conductors 44 are formed by a rod comprising iridium. Generally, an electrode 42 is connected to the current-supply conductors 44 at a side facing the discharge space 24. The electrode is often constituted by tungsten. Furthermore, a current lead 46 is connected to the current-supply conductors 44 at a side facing away from the discharge space 24. The current lead 46 is often constituted by molybdenum for connecting the electrode 42 via the current-supply conductor 44 to a power supply (not shown) for powering the high-pressure discharge lamp 10, 12.

In the embodiment of the discharge lamp 10 shown in FIG. 1A, the discharge vessel 21 comprises a translucent ceramic burner with a wall 210 and a ceramic plug 61, both consisting of a first ceramic material. The translucent ceramic burner wall 210 is substantially cylindrical and is sealed, at the first end portion 31, with the current-supply conductors 44 being the rod comprising iridium and, at the second end portion, with the ceramic plug 61 arranged as a cap on the translucent ceramic burner wall 210. The cylindrical translucent ceramic burner with wall 210 can be manufactured relatively easily and at relatively low cost.

At the first end portion 31 of the ceramic burner 21, the current-supply conductor 44 is directly sealed to the ceramic material of the translucent ceramic burner 21 via a sintered bond 71 between the first ceramic material and the iridium rod of current-supply conductor 44. The sintered bond 71 between the first ceramic material of the translucent ceramic burner wall 210 and the rod of current-supply conductor 44 may be generated, for example, by increasing the temperature of the first ceramic material surrounding the iridium rod of current-supply conductor 44 to a sintering temperature between 1700° C. and 1800° C., using, for example, an oven. Alternatively, the sintered bond 71 may be produced, for example, by first presintering the ceramic burner wall 210 at a temperature between approximately 1000° C. and 1400° C., and subsequently, after applying the iridium rod in a hole of the ceramic burner wall 210, sintering the ceramic burner wall 210 around the iridium rod so as to form a substantially vacuum-tight, sintered bond seal.

At the second end portion 32 of the ceramic burner wall 210, the current-supply conductor 44 is directly sealed to the ceramic plug 61 via a sintered bond 71 between the first ceramic material of the ceramic plug 61 and the rod of current-supply conductor 44. The ceramic plug 61 subsequently seals the translucent ceramic burner, for example, via a further sintered bond 72 between the ceramic plug 61 and the translucent ceramic burner wall 210. In the embodiment shown in FIG. 1A, the first ceramic material of the ceramic plug 61 is substantially identical to the first ceramic material of the translucent ceramic burner wall 210. Use of the ceramic plug 61 has the advantage that it allows a different sintering process for creating the sintered bond 710 between the rod of current-supply conductor 44 and the ceramic plug 61, as compared to the sintering process for creating the sintered bond 71 between the rod of current-supply conductor 44 and the translucent ceramic burner wall 210 as shown at the first end portion 31. When the sintered bond between the rod of current-supply conductor 44 and the translucent ceramic burner wall 210 is created, the sintering process should not alter the translucent characteristics of the translucent ceramic burner wall 210. This limits the choice of sintering processes for creating the sintered bond 710 and thus may result in a less optimal sintered bond 710 between the rod of current-supply conductor 44 and the translucent burner wall 210. Because of the use of the ceramic plug 61, a different sintering process may be chosen for creating the sintered bond 710 between the ceramic plug 61 and the rod of current-supply conductor 44, for example, a process resulting in a stronger bond between the ceramic material of the ceramic plug 61 and the rod of current-supply conductor 44. If this different sintering process alters the translucent characteristics of the first ceramic material of the ceramic plug 61, it will influence the emission characteristic of the high-pressure discharge lamp 10 only marginally. The use of substantially identical first ceramic materials for both the translucent ceramic burner wall 210 and the ceramic plug 61 yields substantially identical material characteristics such as thermal expansion of the ceramic plug 61 and the translucent ceramic burner wall 210. This results in, for example, a relatively low thermal strain between the ceramic plug 61 and the translucent ceramic burner wall 210 when, in operation, the high-pressure discharge lamp 10 heats up and cools down when switched on and off, respectively. This relatively low thermal strain will result in a relatively long lifetime of the high-pressure discharge lamp 10. Furthermore, use of the ceramic plug 61 allows a relatively large opening in the translucent ceramic burner wall 210 which, for example, provides the possibility of using extended structures 48 (see FIG. 1B) at the electrodes 42. These extending structures 48 are also commonly known as coils (not shown) or spheres 48. Use of coils or spheres 48 reduces a blackening effect of the discharge vessel wall 210, which effect is caused by sputtering of tungsten 42, which occurs, for example, during ignition of the high-pressure discharge lamp 10 and, for example, when increasing/dimming the light intensity.

In the embodiment of the discharge lamp 12 shown in FIG. 1B, the discharge vessel 22 comprises a translucent ceramic burner with wall 220 constituted by the first ceramic material and the ceramic plug 61 constituted by a second ceramic material differing from the first ceramic material. The translucent ceramic burner with wall 220 is bulb-shaped and is sealed, at the first end portion 33, with the rod of current-supply conductor 44 and, at the second end portion 34, with the ceramic plug 61 arranged as a cap 61 on the translucent ceramic burner wall 220. The discharge in the discharge space 24 of the bulb-shaped translucent ceramic burner is located further away from the wall of the bulb-shaped translucent ceramic burner wall 220, which typically results in an improved color rendering index of the high-pressure discharge lamp 12 and an improved lifetime due to lower wall temperatures of the translucent ceramic burner wall 220.

At the first end portion 31 of the ceramic burner with wall 220, the rod of current-supply conductor 44 is directly sealed to the first ceramic material of the translucent ceramic burner wall 220 via a sintered bond 71 between the first ceramic material and the iridium rod of current-supply conductor 44, substantially identically to the embodiment shown in FIG. 1A.

At the second end portion 34 of the translucent ceramic burner wall 220, the current-supply conductor 44 is directly sealed to the ceramic plug 61 via a sintered bond 710 between the second ceramic material of the ceramic plug 61 and the rod of current-supply conductor 44. Subsequently, the ceramic plug 61 seals the translucent ceramic burner wall 220, for example, via a further sintered bond 72 between the ceramic plug 61 and the translucent ceramic burner wall 220. The first ceramic material is selected to be, for example, substantially translucent to the light emitted from the discharge of the discharge space 24 of the high-pressure discharge lamp 12 when in operation. The second ceramic material is selected, for example, for obtaining a strong sintered bond 710 between the current-supply conductor 44 and the ceramic plug 61. The translucent characteristics of the second ceramic material for the light emitted from the discharge of the discharge space 24 will influence the emission characteristic of the high-pressure discharge lamp 12 only marginally. This allows a broader selection of second ceramic materials to choose from so as to obtain the strong sintered bond 710 between the rod of current-supply conductor 44 and the ceramic plug 61.

In the embodiments shown in FIGS. 1A and 1B, the ceramic plug 61 may be produced around the current-supply conductor 44 by means of well-known molding processes, such as injection molding, extrusion, and slip-casting.

In an embodiment of the high-pressure discharge lamp 10, 12, the rod of current-supply conductor 44 has a diameter d of less than 600 μm and preferably less than 300 μm. When using a rod having a diameter of less than 600 μm, residual thermal strains at the sintered bond 71, 710 caused, for example, by remaining differences in thermal expansion of the ceramic material and the rod of current-supply conductor 44 will remain relatively small, preventing cracks occurring in the sintered bond 71, 710 when the high-pressure discharge lamp 10, 12 heats up and cools down in use when switched on and off, respectively.

Figure 2A:
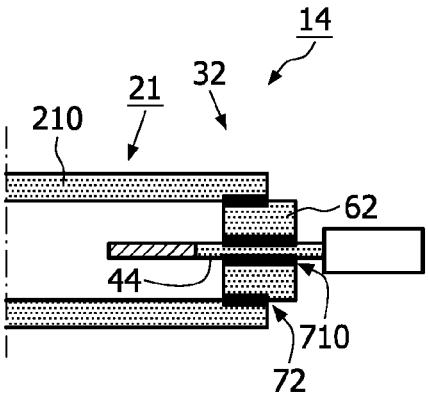
FIGS. 2A and 2B are cross-sectional views of end portions of a high-pressure discharge lamp according to the invention, in which the current-supply conductors are sealed to the ceramic plug arranged in an opening of the translucent ceramic burner.
Figure 2B:
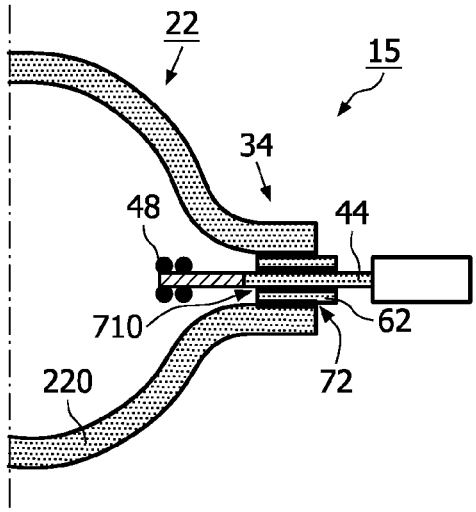

FIGS. 2A and 2B are cross-sectional views of end portions 32, 34 of a high-pressure discharge lamp 14, 15 according to the invention. The discharge vessel 21, 22 is constituted by the translucent ceramic burner with wall 210, 220 and the ceramic plug 62. In contrast with the embodiments shown in FIGS. 1A and 1B, the ceramic plugs 62 shown in FIGS. 2A and 2B are substantially arranged in the opening of the translucent ceramic burner wall 210, 220, rather than as a cap 61 as shown in FIGS. 1A and 1B. This arrangement of the ceramic plug 62 typically generates a sintered bond between the ceramic plug 62 and the translucent ceramic burner wall 210, 220, which bond is stronger as compared to the application of the ceramic plug 61 as a cap on the opening of the translucent ceramic burner wall 210, 220 in FIGS. 1A and 1B. To obtain this strong sintered bond 72, the ceramic plug 62 is, for example, presintered at a higher temperature than the translucent ceramic burner wall 210, 220. When the presintered ceramic plug 62 is sintered to the presintered translucent ceramic burner wall 210, 220, this wall 210, 220 will shrink more than the ceramic plug 62, creating a substantially vacuum-tight and strong bond. Furthermore, this stronger sintered bond 72 typically results from an increased connection area of the sintered bond 72 when the ceramic plug 62 fits in the opening of the translucent ceramic burner wall 210, 220.

In the embodiment shown in FIG. 2A, the substantially cylindrical translucent ceramic burner wall 210 and the ceramic plug 62 are both constituted by the first ceramic material. The sintered bond 710 is arranged between the current-supply conductor 44 and the ceramic plug 62, and the further sintered bond 72 is arranged between the ceramic plug 62 and the translucent ceramic burner wall 210. Again, use of the first ceramic material for the ceramic plug 62 as well as the translucent ceramic burner wall 210 results in, for example, a relatively low thermal strain between the ceramic plug 62 and the translucent ceramic burner wall 210 when, in operation, the high-pressure discharge lamp 14 heats up and cools down when switched on and off, respectively. This relatively low thermal strain will result in a relatively long lifetime of the high-pressure discharge lamp 14. The sintering process for sealing the current-supply conductor 44 to the ceramic plug 62 may be optimized for the strong and crack-free sintered bond 710, possibly losing part of the translucent characteristics of the first ceramic material of the ceramic plug 62.

In the embodiment shown in FIG. 2B, the bulb-shaped translucent ceramic burner wall 220 is constituted by the first ceramic material, and the ceramic plug 62 is constituted by the second ceramic material. The first ceramic material is selected to be, for example, substantially translucent to the light emitted from the discharge of the discharge space 24 of the high-pressure discharge lamp 15 when in operation. The second ceramic material is selected, for example, for obtaining a strong sintered bond 710 between the current-supply conductor 44 and the ceramic plug 61.

In the embodiments shown in FIGS. 2A and 2B, the ceramic plug 62 extends from the translucent ceramic burner wall 210, 220. However, the ceramic plug 62 may also be arranged in the end portions 31, 33 of the high-pressure discharge lamp.

Figure 3A:
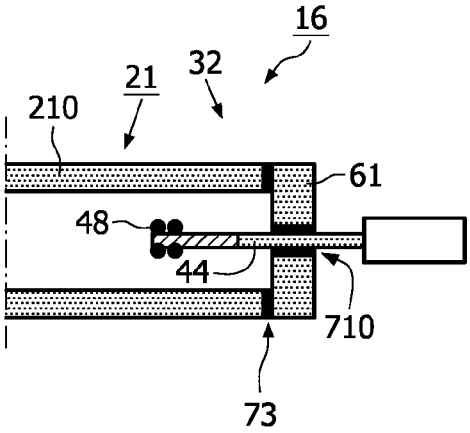
FIGS. 3A and 3B are cross-sectional views of end portions of a high-pressure discharge lamp according to the invention, in which the current-supply conductors are sealed to the ceramic plug arranged as a cap on an opening of the translucent ceramic burner, the ceramic plug being attached to the translucent ceramic burner by means of a frit.
Figure 3B:
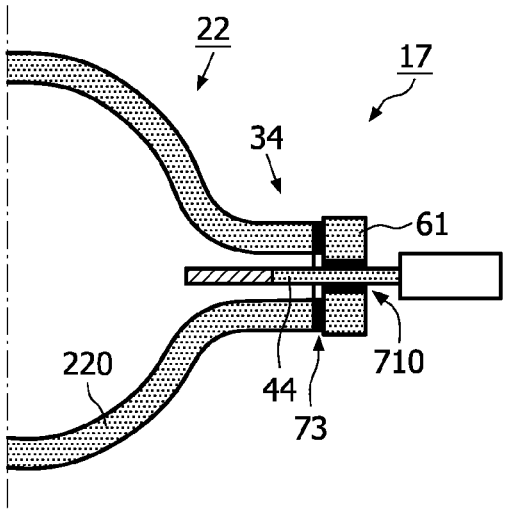

FIGS. 3A and 3B are cross-sectional views of end portions 32, 34 of a high-pressure discharge lamp 16, 17 according to the invention, in which the current-supply conductors 44 are sealed to the ceramic plug 61 arranged as a cap on the opening of the translucent ceramic burner 21, 22, the ceramic plug 61 being attached to the translucent ceramic burner wall 210, 220 by means of a frit 73. The discharge vessel 21, 22 of the high-pressure discharge lamp 16, 17 is constituted by the translucent ceramic burner wall 210, 220 and the ceramic plug 61. Use of the frit 73 allows a relatively quick closure of the discharge vessel 21, 22 at relatively low temperatures. This is especially beneficial when using mercury in the ionizable filling of the high-pressure discharge lamp 16, 17 because the temperature of the ionizable filling comprising mercury should not exceed 300° C. so as to prevent evaporation of the mercury before the translucent ceramic burner is sealed.

In the embodiment shown in FIG. 3A, the substantially cylindrical translucent ceramic burner wall 210 is constituted by the first ceramic material, and the ceramic plug 62 is constituted by the second ceramic material. Again, the first ceramic material is selected to be, for example, substantially translucent to the light emitted from the discharge of the discharge space 24 of the high-pressure discharge lamp 16 when in operation. The second ceramic material is selected, for example, for obtaining a strong sintered bond 710 between the current-supply conductor 44 and the ceramic plug 61.

In the embodiment shown in FIG. 3B, the bulb-shaped translucent ceramic burner wall 220 and the ceramic plug 61 are both constituted by the first ceramic material. The sintered bond 710 is arranged between the current-supply conductor 44 and the ceramic plug 61, and the frit 73 is arranged between the ceramic plug 61 and the translucent ceramic burner wall 220. Again, use of the first ceramic material for the ceramic plug 62 as well as the translucent ceramic burner wall 220 results in, for example, a relatively low thermal strain between the ceramic plug 62 and the translucent ceramic burner wall 220 of the high-pressure discharge lamp 17 in operation. This relatively low thermal strain (in operation) between the translucent ceramic burner wall 220 and the ceramic plug 62 results in a relatively low thermal strain on the frit 73, which prevents cracks appearing in the frit 73 and increases the lifetime of the high-pressure discharge lamp 17. The sintering process for sealing the current-supply conductor 44 to the ceramic plug 62 may be optimized for the strong and crack-free sintered bond 710, possibly losing part of the translucent characteristics of the first ceramic material of the ceramic plug 62.

Figure 4A:
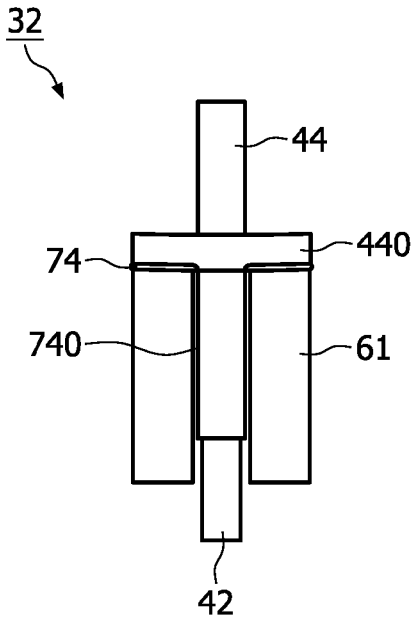
FIGS. 4A and 4B are cross-sectional views of end portions of a high-pressure discharge lamp according to the invention, in which the direct seal is arranged between the current-supply conductors and the translucent ceramic burner by means of a sealing frit for sealing the current-supply conductors to the translucent ceramic burner.
Figure 4B:
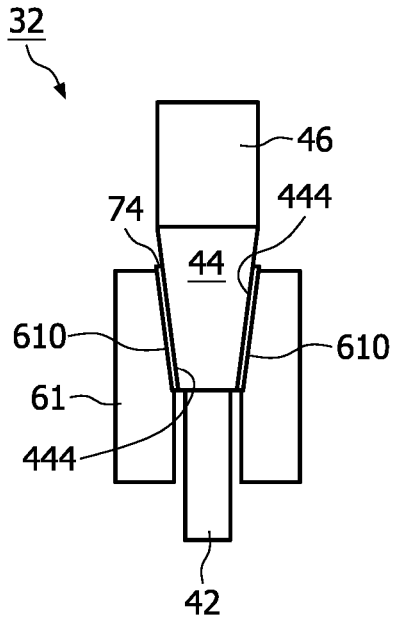

FIGS. 4A and 4B are cross-sectional views of end portions 32 of a high-pressure discharge lamp according to the invention, in which a sealing frit 74 is arranged between the current-supply conductors 44 and the translucent ceramic plug 61 forming the direct seal of the current-supply conductors 44 to the translucent ceramic material of the discharge vessel (not shown). The sealing frit 74 is composed of, for example, $Al_2O_3$, $Dy_2O_3$ and $SiO_2$. It forms a vacuum-tight seal around the current-supply conductor 44, sealing the translucent ceramic burner wall 210, 220.

FIG. 4A shows an embodiment of the sealing construction of the high-pressure discharge lamp in which the Ir rod is provided with a flange 440, which has been sealed on the outside surface of the ceramic plug 61 by means of the sealing frit 74. In this construction, the flange 440 forms a kind of cap on the head of the ceramic plug 61. Alternatively, the flange 440 is sealed directly to the end of the ceramic vessel wall. By nature of its shape, flowing of the sealing frit into the discharge space is virtually impossible, whilst at the same time the seal formed by the sealing frit 74 is located at a relatively large distance from the discharge when the lamp is in operation. In this way, both advantages of keeping the sealing frit out of the discharge space and keeping it relatively cool during lamp operation are achieved. A very thin crevice 740, which can partly be filled with sealing frit, is left along the length of the ceramic plug 61 and the Ir rod forming the current-supply conductor 44. By partly filling the crevice 740, its volume is as small as possible, thus minimizing the volume available for filling constituents to condense during lamp operation.

FIG. 4B shows an embodiment of the sealing construction of the high-pressure discharge lamp in which the Ir rod and the ceramic plug 61 are tapered at the location of the seal. The tapered form of both the ceramic part over section 610 and the Ir rod as current-supply conductor 44 over section 444 provides a self-aligning fit between both pieces and thus contributes to an even distribution of the sealing frit 74 across the length of the seal. Besides, the shape of said construction helps to prevent the sealing frit 74 from flowing into the discharge space during the sealing process. Alternatively, a direct seal is made between the Ir rod as current-supply conductor 44 with a tapered section 444 and a tapered section at the end of the ceramic discharge vessel.

It is further possible to have a combination of one of the described types of direct seals by means of a sealing frit at one end of the discharge vessel with a further one at the other end of the discharge vessel.

In the constructions with a direct seal by means of a sealing frit, the Ir rod preferably has a small diameter of, for example, ≦400 μm, preferably ≦300 μm at least when tapered at the end connected to the electrode 42. The flange 440 preferably has the following dimensions: outer diameter 2 mm, or more preferably 1 mm; flange thickness 100 μm or less. A frit length of 0.5 to 0.8 mm has shown to be sufficient to achieve a vacuum-tight seal capable of lasting the lifetime of the lamp.

Figure 5:
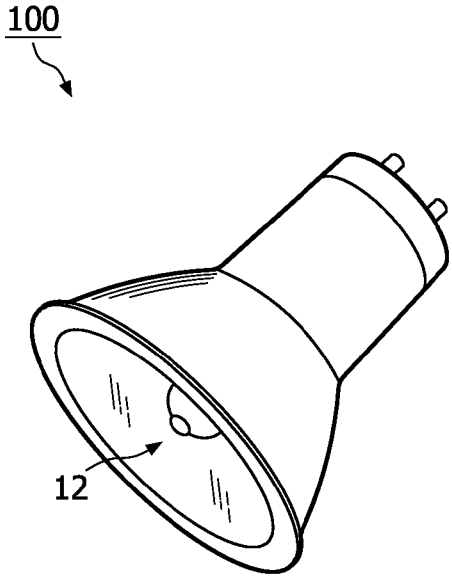
FIG. 5 shows a reflector lamp according to the invention.

FIG. 5 shows a reflector lamp 100 according to the invention. The reflector lamp 100 comprises the high-pressure discharge lamp 12 according to the invention.

It should be noted that the above-mentioned embodiments illustrate rather than limit the invention, and that those skilled in the art will be able to design many alternative embodiments without departing from the scope of the appended claims.

It will be apparent to the person skilled in the art that each end portion 31, 32, 33, 34 shown in FIGS. 1 to 4, including any combination of different end portions 31, 32, 33, 34, can be applied to obtain a high-pressure discharge lamp 10, 12, 14, 15, 16, 17, 18, 19 according to the invention, without departing from the scope of the invention.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A high-pressure discharge lamp comprising:

a ceramic discharge vessel enclosing a discharge space which is provided with an ionizable filling comprising one or more halides, the ceramic discharge vessel having a first end portion and a second end portion;

current-supply conductors issuing through the first end portion and the second end portion to respective electrodes arranged in the discharge space so as to maintain a discharge, wherein at least one of the current-supply conductors is formed as a rod comprising iridium, and wherein a seal is formed in a crevice along length of the rod located within a wall of the ceramic discharge vessel between the rod and the wall, the rod being sealed to the wall of the ceramic discharge vessel by a sealing frit located in the crevice.

2. The lamp as claimed in claim 1, wherein the rod and the ceramic discharge vessel are tapered at a location of the direct seal.

3. The lamp as claimed in claim 1, wherein the rod is provided with a flange which is directly sealed on an outside surface of the ceramic discharge vessel by the sealing frit.

4. The high-pressure discharge lamp of claim 3, wherein the flange does not extend beyond the outside surface to cover sidewalls of the ceramic discharge vessel.

* * * * *